US006332670B1

(12) United States Patent
Kagayama et al.

(10) Patent No.: US 6,332,670 B1
(45) Date of Patent: Dec. 25, 2001

(54) RECORDING HEAD FOR FORMING IMAGES WITH CHARGED PARTICLES

(75) Inventors: Shigeru Kagayama; Tetsuya Kitamura, both of Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/296,168

(22) Filed: Apr. 22, 1999

(30) Foreign Application Priority Data

Apr. 23, 1998 (JP) ..... 10-129539

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 290, 292, 293, 294, 295

(56) References Cited

U.S. PATENT DOCUMENTS 5,404,155 4/1995 Kitamura .
5,552,814 9/1996 Maeda et al. .
5,587,264 * 12/1996 Iijima et al. .
5,883,648 3/1999 Maeda .
5,883,649 3/1999 Maeda .
5,905,516 * 5/1999 Kagayama ..... 347/55

* cited by examiner

*Primary Examiner*—Raquel Yvette Gordon
(74) *Attorney, Agent, or Firm*—Oliff & Berridge, PLC

(57) ABSTRACT

A film 33 is adhered using an adhesive layer 32 to the lower surface of an insulation sheet 31 that contacts the peripheral surface of atoner bearing roller. Apertures 34 are formed through the insulation sheet 31, the adhesive layer 32 and the film 33. An indentation portion 37 is formed around each aperture 34 in an upper surface 39 of the insulation sheet 31. Because the insulation sheet 31 and the film 33 are not attached into an integral unit using baking, the resultant member will not warp by differences in thermal expansion of the insulation sheet 31 and the film 33, as would occur if the two were baked together. Because the film 33 is extremely hard and smooth, toner will not pierce into the film 33 .

23 Claims, 9 Drawing Sheets

RECORDING HEAD FOR FORMING IMAGES WITH CHARGED PARTICLES

BACKGROUND OF THE INVENTION

1. Field of the Invention

The present invention relates to a print head for printing images on a reception medium by impinging charged particles on the reception medium.

2. Description of the Related Art

FIG. 1 is a cross-sectional view showing essential configuration of a well known image forming device provided with a recording head.

An image forming device 10 la provided with a toner supply unit 11, which includes a toner case 13 filled with charged particles, such as toner 12. A variety of components are provided within the toner case 13, including a toner supply roller 15, a toner bearing roller 14, and a blade 16. The toner supply roller 15 supplies charged toner to the outer peripheral surface of the toner bearing roller 14. The toner tearing roller 14 has a cylindrical shape and bears, on its outer peripheral surface, the charged toner supplied by the toner supply roller 15. The blade 16 regulates the thickness of the toner layer supported on the outer peripheral surface of the toner bearing roller 14 to a uniform layer thickness.

An aperture electrode member 17 formed with a plurality of apertures is disposed above the toner bearing roller 14. The aperture electrode member 17 is supported with the apertures in confrontation with, and in resilient contact with, the outer peripheral surface of the toner bearing roller 14. The aperture electrode member 17 is formed with a plurality of electrodes in the vicinity of the apertures. The electrodes are for controlling passage of toner 12 from the outer peripheral surface of the toner bearing roller 14 through the apertures.

Detailed configuration of the aperture electrode member 17 will be described while referring to FIGS. 2 to 3 (C). FIG. 2 is a perspective view showing overall configuration of the aperture electrode member 17. FIG. 3 (A) is a magnified view showing a portion of the aperture electrode member 17 shown in FIG. 2. FIG. 3 (B) is a cross-sectional view taking along a line C—C of FIG. 3 (A). FIG. 3 (C) is a magnified view showing an insulation sheet of the aperture electrode member 17 shown in FIG. 3 (A).

As shown in FIG. 2, the aperture electrode member 17 includes an insulation sleet 17*a* and IC chips 17*d* disposed on the insulation sheet 17*a*. The insulation sheet 17*a* is formed from a synthetic resin, such as polyimide, to a thickness of 25 $\mu$m. A plurality of apertures 17*b* are formed through the insulation sheet 17*a*, aligned with a lengthwise direction of the insulation sheet 17*a*. It should be rioted that because the apertures are formed with such a narrow pitch, they are indicated by a straight line in FIG. 2.

An shown in greater detail in FIG. 3 (A), the aperture electrode member 17 also includes control electrodes 17*c* provided between adjacent apertures 17*b*, and conductive lines 17*e* for connecting the IC chips 17*d* with the control electrodes 17*c*. With this configuration, the IC chips 17*d* can apply a control voltage to energize the control electrodes 17*c*.

As shown in FIG. 3 (B), a coat layer 17*f* is formed on the lower surface of the insulation sheet 17*a*, that is, on the surface that directly contacts the outer peripheral surface of the toner bearing roller 14. The coat layer 17*f* is formed mainly from a polyimide type base binder, but also includes carbon as a conductive material, flourine dioxide for reducing friction force, and a charge control agent (CCA).

Returning to FIG. 1, the image forming device 10 is also provided with a control circuit 18, a DC voltage source 20, a heat roller 22, a pressure roller 23, and a cylindrical back electrode roller 19. The control circuit 18 is for controlling the IC chips 17. Each IC chip 39 of the aperture electrode member 17 is connected to the control circuit 18. The cylindrical back electrode roller 19 is rotatably disposed in confrontation with the aperture electrode member 17 and is connected to a DC voltage source 20. The heat roller 22 and the pressure roller 23 are disposed in confrontation with each other at a position downstream in a transport direction of a reception medium 21 from the back electrode roller 19.

Next, operations of the image forming device 10 will be described. First, the toner supply roller 15 and the toner bearing roller 14 are rotated in a direction indicated by arrows F1 and F2, respectively, of FIG. 1. Rotation of the toner supply roller 15 transports toner 12 stored in the toner case 13 toward the toner bearing roller 14, and scrapes the toner 12 onto the outer surface of the toner bearing roller 14. Resultant friction charges the toner to a negative charge. Next, the blade 16 regulates the toner 12 borne on the outer peripheral surface of the toner bearing roller 14 into a uniform thin layer. Further rotation of the toner bearing roller 14 convoys the thin layer of toner 12 on the toner bearing roller 14 towards the lower surface of the aperture electrode member 31. An a result, this toner 12 borne on the outer peripheral surface of the toner bearing roller 14 is supplied to a position beneath the apertures 17*b* while being scraped along the lower surface, that is, the coat layer 17*f* of the aperture electrode member 17.

The control circuit 18 applies, for example, a positive 40 V voltage to selected ones of the control electrode 17*c* in accordance with inputted image information. Difference in electric potential between the control electrodes 17*c* and the toner bearing roller 14 generates electric lines of force in the vicinity of the apertures 17*b* corresponding to control electrodes 17*c* applied with the voltage by the control circuit 18. The electric lines of force extend from the control electrodes 17*c* towards the toner bearing roller 14, whereupon the negatively charged toner 12 borne on the outer peripheral surface of the toner bearing roller 14 is drawn towards the high electric potential near the apertures l7*b*. The toner 12 that separates from the toner bearing roller 14 in this manner is caught in the electric field formed between the reception medium 21 and the control electrodes 17*c* by a voltage applied to the back electrode roller 19. The toner 12 is that further drawn toward to, and impinged on, the reception medium 21 to form an image by accumulating an the surface of the reception medium 21.

A single line's worth of pixels is formed by controlling passage of toner 12 through the apertures 17*b* one time. Once a single line's worth pixels has been formed, the back electrode roller 19 is rotated in a direction indicated by an arrow F3 in FIG. 1, in order to transport the reception medium 21 by a single pixel distance. By repeating the above described processes, all lines of an image can be formed in toner on the reception member 21. The toner image is then fixed on the surface of the reception member 21 by the heat roller 22 and the pressure roller 23.

SUMMARY OF THE INVENTION

To form the coat layer 17*f* on the aperture electrode member 17, a coat liquid, which will form the coat layer 17*f*, is coated directly on the surface of the insulation sheet 17*a*. Then, the entire insulation sheet 17*a* is heated to bake the coat layer 17*f* and the insulation Sheet 17*a* into an integral member. This baking process is performed at a low temperature. For example, when the insulation sheet 17*a* is formed from polyimide, the baking process is performed at 200° C. or less.

However, if the insulation sheet 17*a* and the coat layer 17*f* have different thermal expansion coefficients, then the aperture electrode member 17 can warp due to the differences in thermal expansion when the insulation sheet 17*a*and the coat layer 17*f* are baked integrally together, As a result, materials for both the insulation sheet 17*a* and the coat layer 17*f* need to be made from materials that have the same thermal expansion coefficient.

Also, the coat layer 17*f* must be a material that polymerizes at a low baking temperature, otherwise the insulation sheet 17*a* and the control electrode 17*c* might be damaged by oxidation resulting from beat generated during the baking process.

Also, the material used to form the coat layer 17*f* is limited to one that conforms to the insulation sheet 17*a*, and must be a relatively soft material to avoid warping the aperture electrode member 17.

Furthermore, when polyimide is baked at about 200° C., polymerization is incomplete. For this reason, the resultant film is relatively soft, having a Young's modulus of 100 $kg/mm^2$ or less and also insufficiently smooth. This is true of all materials that polymerize when baked. That is, if the baking temperature is too low, then polymerization is incomplete, so that the resultant film is too soft and also rough.

Sharp portions on the surface of toner particles can pierce the soft coat layer 17*f* when the toner borne on the outer peripheral surface of the toner bearing roller 14 contacts the coat layer 17*f*. Toner 12 can accumulate between the coat layer 17*f* and the toner bearing roller 14 as a result. When the toner accumulates between the coat layer 17*f* and the toner bearing roller 14, the distance between the aperture electrode member 17 and the toner bearing roller 14 can increase. Also, the accumulated toner can clog the apertures 17*b*. In either case, quality of recorded images suffers.

Even if attempts are made to clean off the toner accumulated on the coat layer 17*f*, the toner cannot be easily cleaned off because the sharp corner portions pierce into the coat layer 17*f* so the toner sticks tenaciously to the coat layer 17*f*.

It is an objective of the present invention to provide an aperture electrode member capable of forming high quality images without warping, wherein charged particles do not easily cling to at least surfaces near apertures.

In order to achieve the above-described objective, a recording head according to the present invention has an insulation layer formed with apertures, and a layer that prevents clinging of charged particles, wherein the layer is adhered to a surface of the insulation layer to which charged particles are supplied, at least at locations surrounding the apertures.

With this configuration, the apertures will not be clogged by charged particles clinging to the surface surrounding the apertures. Because the anti-cling film is integral with the surface surrounding the apertures by being adhered rather than by baking the recording head will not warp even if materials of the anti-cling film, and of the surface to which the anti-cling film is adhered, have different thermal expansion coefficients.

The recording head with this configuration can be produced by adhering the anti-cling layer to at least surfaces of the insulation sheet around the apertures.

The effects of the present invention are more striking when applied to an image forming device having a charged particle supply means that supplies charged particles to the recording head by scraping contact with the recording head. In this case, the charged particle supply means has a moving body that bears charged particles on its moving surface. The moving surface scrapes against the surface of the recording head formed with the anti-cling layer to supply the charged particles.

With such a charged particle supply unit, the charged particles are more apt to dig into the anti-cling film compared to a mechanism where no contact is involved. However, by adhering an extremely hard anti-cling film to the corresponding surface of the recording head, the charge particles can be prevented from digging into the recording head.

It is desirable that the anti-cling film have a heat-resistance macromolecular material as its main component, because heat-resistance macromolecular materials have excellent heat-resistant properties and are very hard.

It is desirable that polyimide resin be used as the heat-resistant macromolecular material because polyimide resin has excellent heat-resistant properties, is extremely hard, and is easy to handle.

It to desirable that the anti-cling film contain a lubricant and an anti-static agent. Because the film includes a lubricating agent, the surface roughness Rz of the anti-cling film can be reduced so that charged particles can be further prevented from clinging to the recording head. Also, because the anti-cling film includes an anti-static agent, the surface of the anti-cling film can be prevented from charging up so that the charged particles can be prevented from clinging to the anti-cling surface by static charge.

It is desirable that the anti-cling film be adhered by a material having an anti-static property. In this case, by adhering the anti-cling film to the surface of the recording head using an adhesive with anti-static properties, the surface of the anti-cling film can be further prevented from charging, so that an amount of charged particles clinging to the surface of the anti-cling film can be further reduced.

BRIEF DESCRIPTION OF THE DRAWINGS

The above and other objects, features and advantages of the invention will become more apparent from reading the following description of the preferred embodiment taken in connection with the accompanying drawings in which:

FIG. 3 (B) is a cross-sectional view taking along a line C—C of FIG. 3 (A);

FIG. 3 (C) is a magnified view showing an insulation sheet of the aperture electrode member shown in FIG. 3 (A);

FIG. 6 (B) is a cross-sectional view taking along a line A—A of FIG. 6 (A);

FIG. 6 (C) is a partial magnified view showing an anti-cling film adhered to the aperture electrode member of FIG. 5;

FIG. 8 (B) is a cross-sectional view showing the coat liquid applied on a plate, and being reduced to a thin layer by a squeegee;

FIG. 8 (C) is a cross-sectional view showing the resultant thin layer of the coat liquid;

FIG. 8 (D) is a cross-sectional view showing a film resulting from baking the thin layer on the plate;

FIG. 8 (E) in a cross-sectional view showing the baked film being peeled off the plate;

FIG. 8 (F) is a cross-sectional view showing the baked film;

FIG. 8 (G) is a cross-sectional view showing the anti-cling film adhered to an insulation sheet using an adhesive layer;

FIG. 8 (H) is a cross-sectional view showing the upper surface of the insulation sheet being irradiated by laser light;

FIG. 8 (I) is a cross-sectional view showing apertures opened through the film, the adhesive layer, and the insulation sheet by the laser light;

FIG. 9 (B) is a cross-sectional view taking along a line B—B of FIG. 9 (A); and FIG. 9 (C) is a partial magnified view showing an anti-cling film of the aperture electrode member of FIG. 9 (A).

DETAILED DESCRIPTION OF THE EMBODIMENTS

Figure 1:
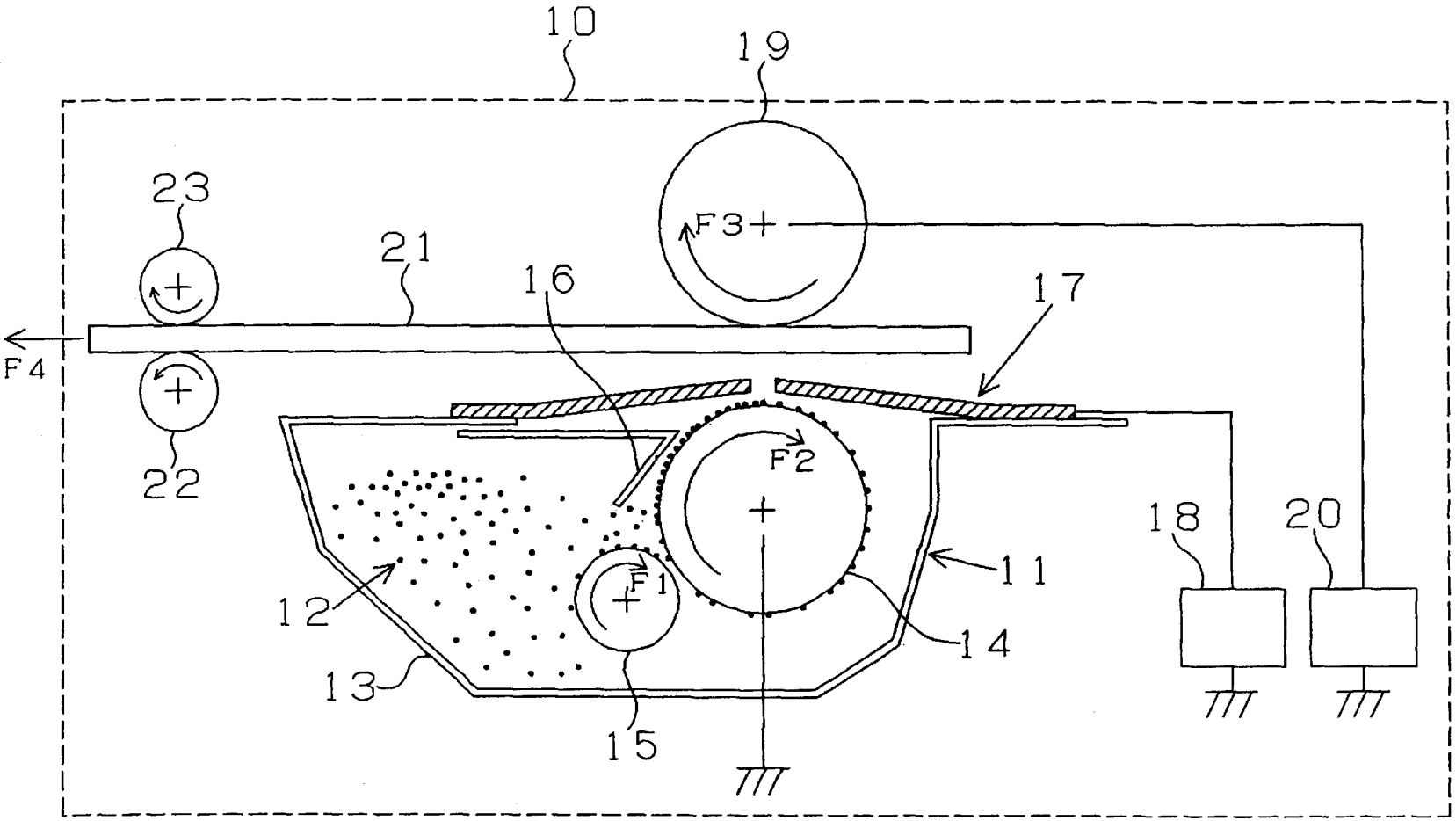
FIG. 1 is a cross-sectional view showing a conventional image forming device.
Figure 2:
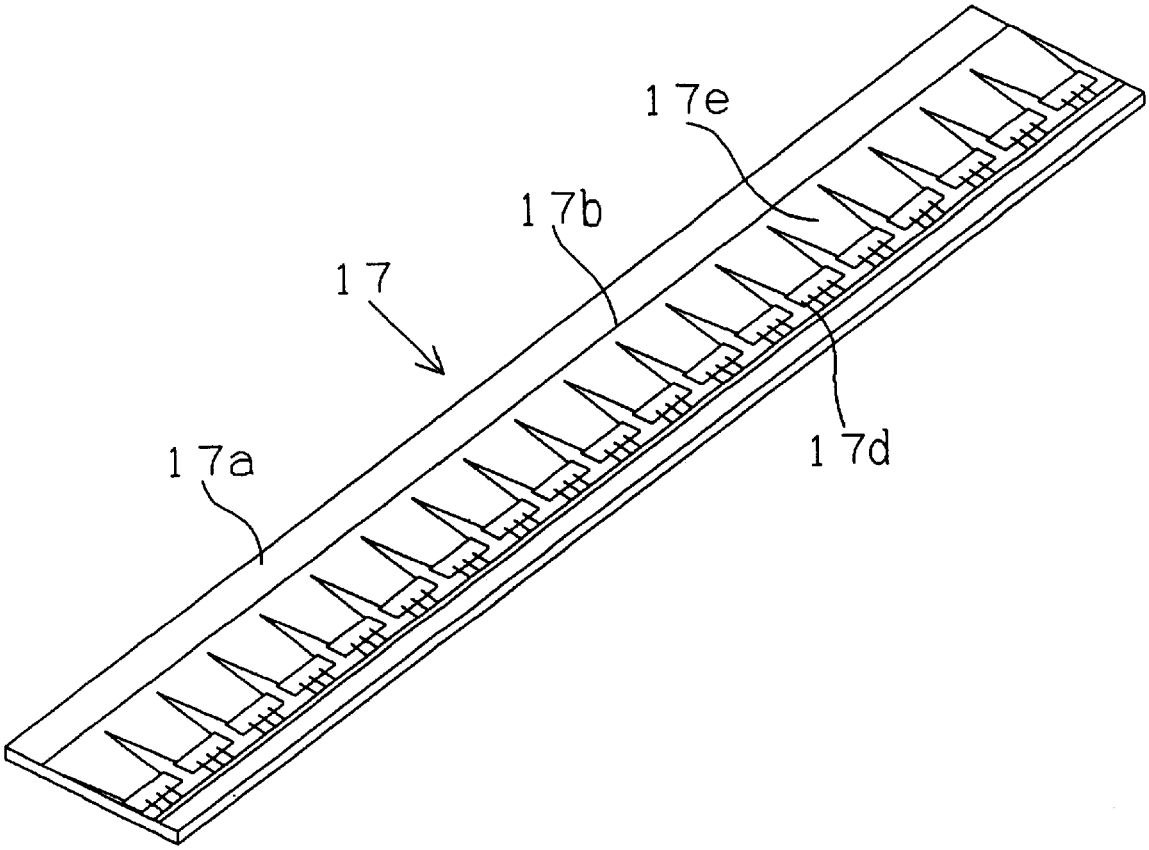
FIG. 2 is a perspective view showing an aperture electrode member of the image forming device of FIG. 1.
Figure 3:
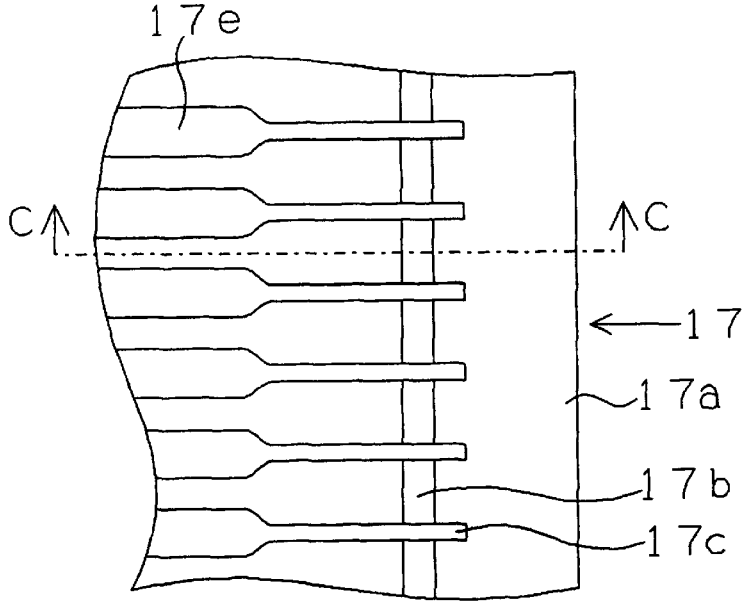
FIG. 3 (A) is a magnified view showing a portion of the aperture electrode member shown in FIG. 2.
Figure 3:
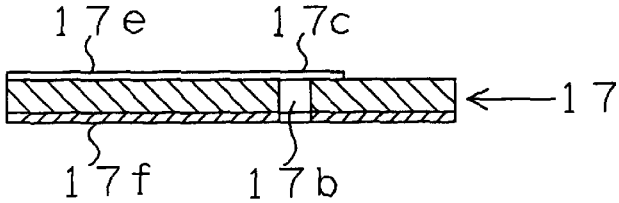
Figure 3:
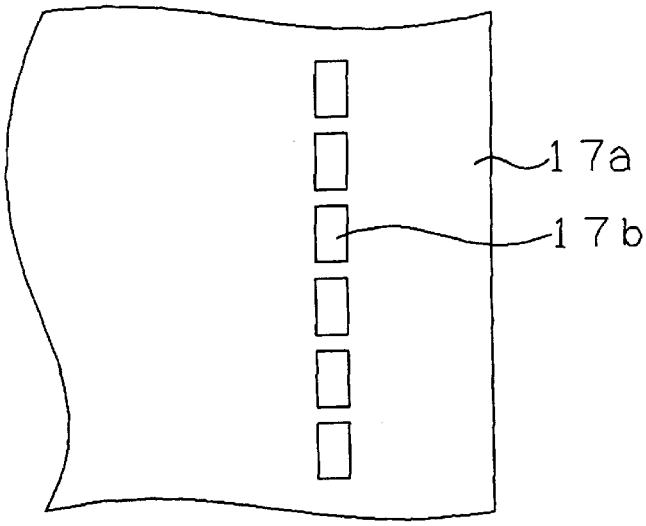
Figure 4:
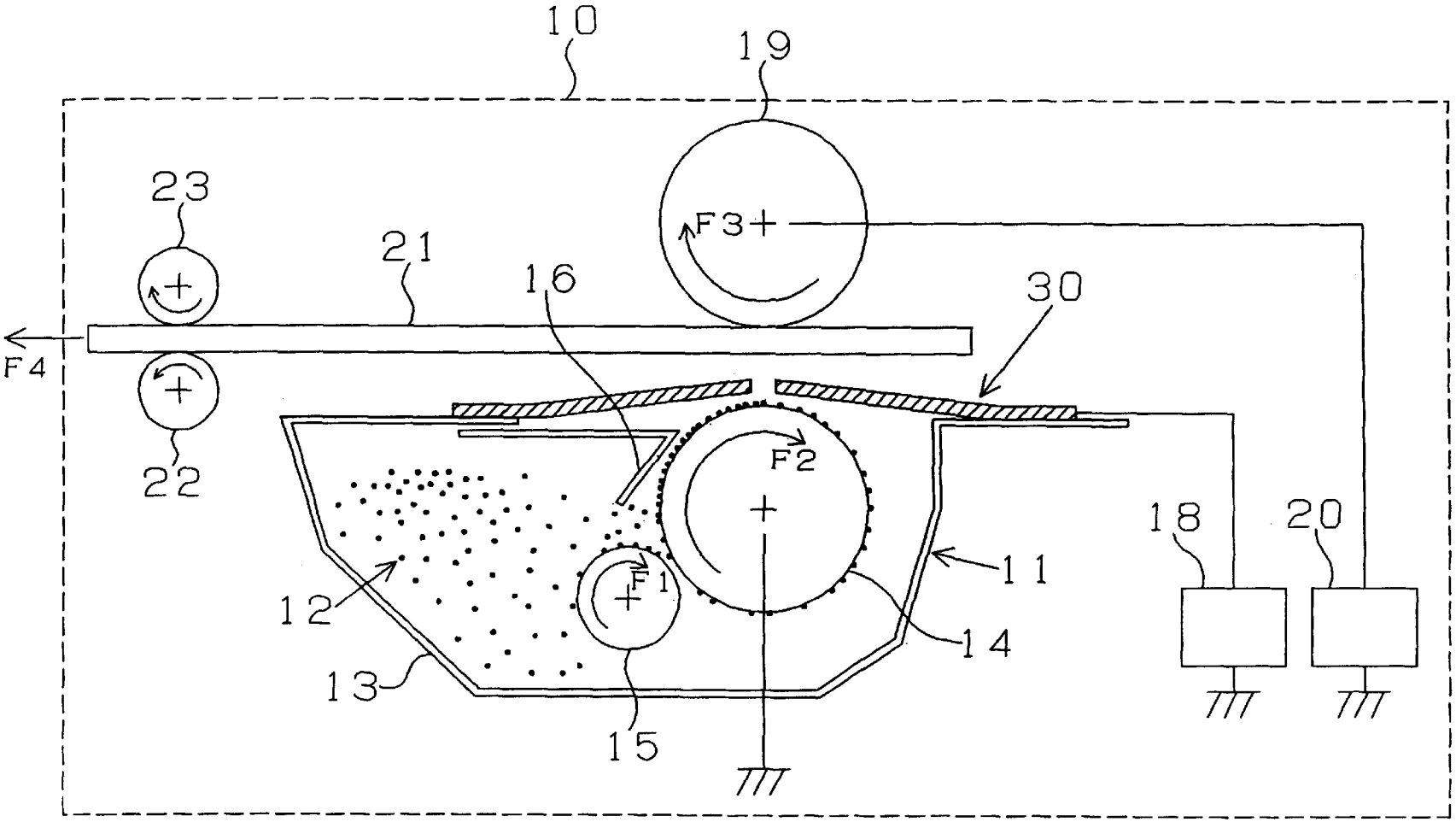
FIG. 4 is a cross-sectional view showing an image forming device according to an embodiment of the present invention.

Next, an image forming device including a recording head according to a first embodiment of the present invention will be described while referring to the attached drawings. As shown in FIG. 4, the image forming device according to the present embodiment includes substantially the same configuration as the conventional device shown in FIG. 1, except that the aperture electrode member 17 is replaced with an aperture electrode member 30 according to the present invention.

Figure 5:
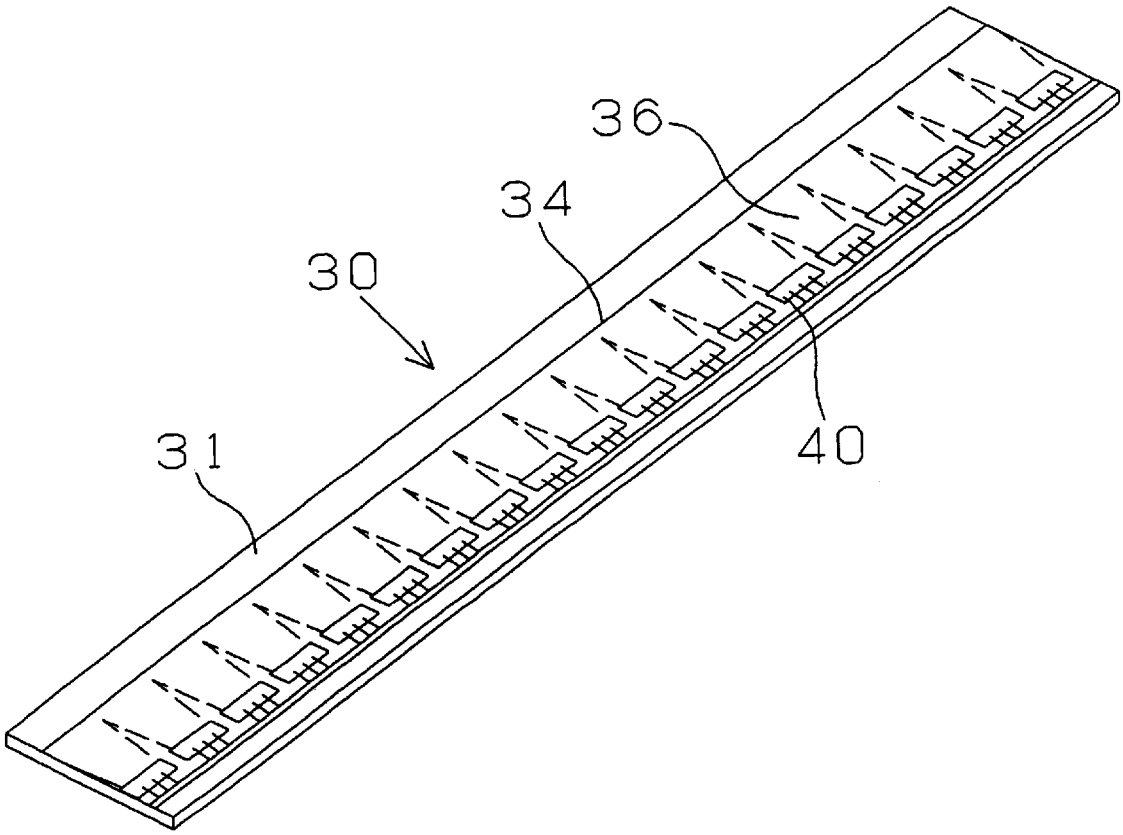
FIG. 5 is a perspective view showing outer configuration of the aperture electrode member according to an embodiment of the present invention.
Figure 6:
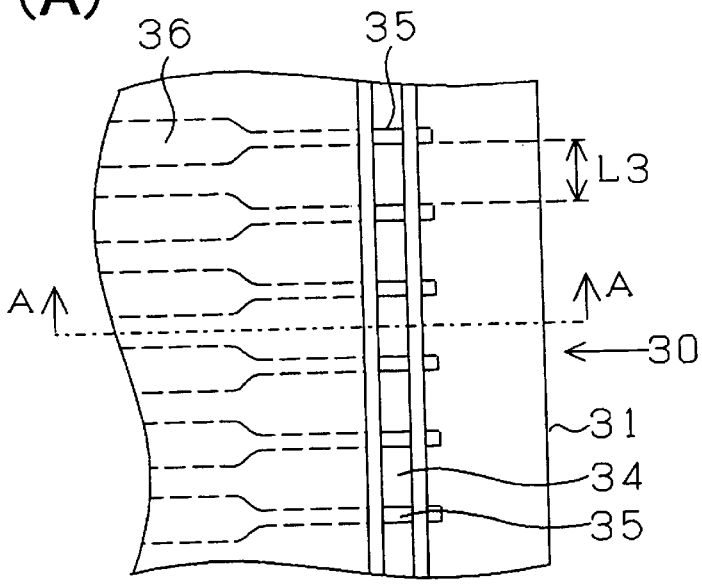
FIG. 6 (A) is a partial magnified view showing the aperture electrode member of FIG. 5.
Figure 6:
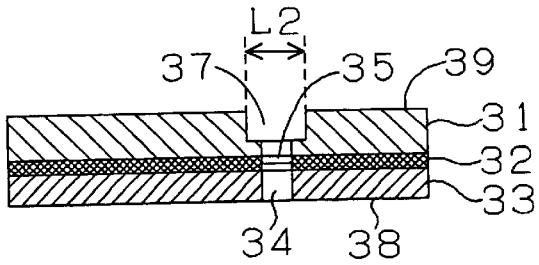
Figure 6:
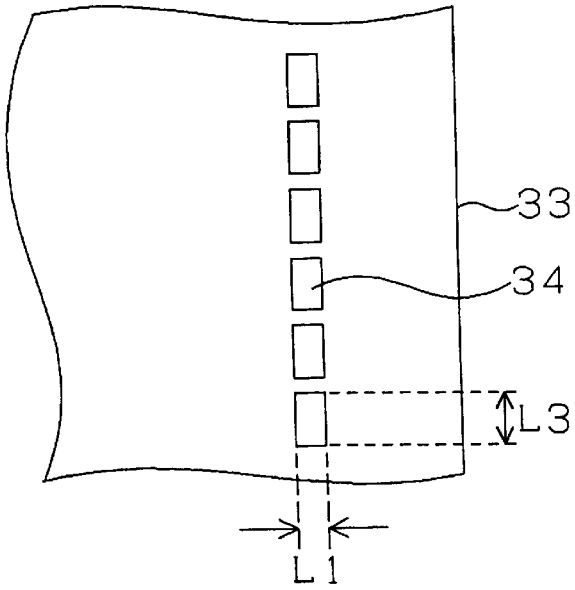

FIG. 5 is a perspective view showing outer configuration of the aperture electrode member 30. FIG. 6 (A) is a partial magnified view showing the aperture electrode member 30 of FIG. 5. FIG. 6 (B) is a cross-sectional view talking along a line A—A of FIG. 6 (A). FIG. 6 (C) is a partial magnified view showing a film 33 of the aperture electrode member 30 of FIG. 6.

As shown in FIG. 5, the aperture electrode member 30 includes an insulation sheet 31 and a plurality of IC chips 40. The insulation sheet 31 can be made from a polyimide resin material. According to the present embodiment, the insulation sheet 31 is formed from polyimide, and has a resistance of greater than $10^{16}$ ohms. Other properties of the insulation sheet 31 conform with properties of the film 33. The properties of the film will be described later. A plurality of apertures 34 are formed in the insulation sheet 31, following a lengthwise direction of the aperture electrode member 30.

As shown in FIG. 6 (A), the aperture electrode member 30 also includes control electrodes 35, and connection lines 36 that connect the control electrodes 35 to the IC Chips 40. With this configuration, the plurality of IC chips 40 can apply control voltages to the control electrodes 35 via the connection lines 36.

As shown in FIG. 6 (B), the film 33 shown in FIG. 6 (C) is adhered to the lower surface of the insulation sheet 31 by an adhesive layer 32. In other words, the surface of the aperture electrode member 30 that directly contacts the peripheral surface of the toner bearing roller 14 is formed from the adhered film 33. The apertures 34 penetrate through the insulation sheet 31, the adhesive layer 32, and the film 33. A separate indentation portion 37 is formed in an upper surface 39 around each aperture 34.

The adhesive layer 32 according to the present embodiment has a modulus of elasticity (Young's Modulus) of 10 to 100 kg/mm$^2$; a thermal expansion coefficient of 10 to 100 ppm/° C.; a curing temperature of 200° C. or less; and a thickness of 2 microns to 20 microns or greater.

The film 33 according to the present embodiment has a resistance of about $10^7$ to $10^{16}$ ohms; a modulus of elasticity (Young's Modulus) of 200 kg/mm$^2$ or greater, desirably 300 kg/mm$^2$ or greater, and more desirably 900 kg/mm$^2$ or greater; a pencil hardness of H or greater, and desirably 3H or greater; a thickness of from 3 microns to 50 microns, desirably about 10 microns; and a surface roughness equivalent to a polished mirror surface, that is, Ra 0.1 micron or less.

Figure 7:
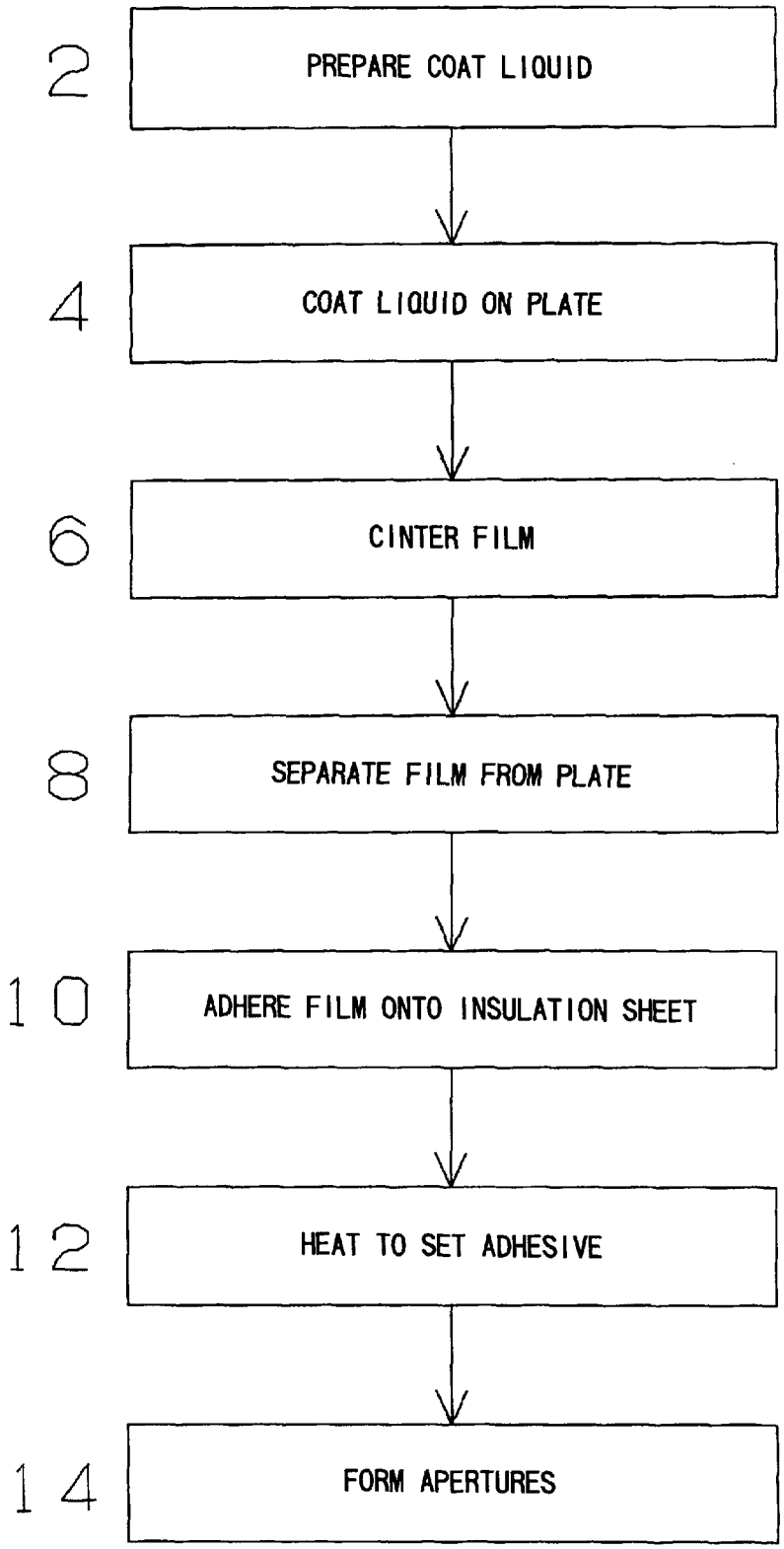
FIG. 7 is a schematic view representing processes for manufacturing the anti-cling film.
Figure 8:
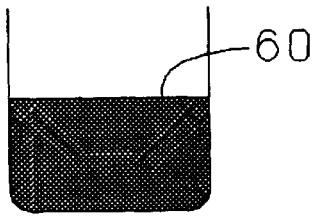
FIG. 8 (A) is a side view of a beaker containing a coat liquid for forming the anti-cling film.
Figure 8:
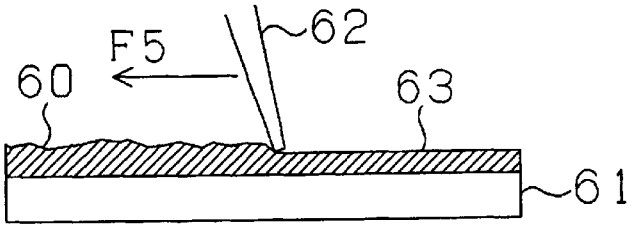
Figure 8:
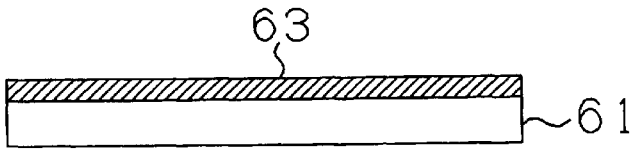
Figure 8:
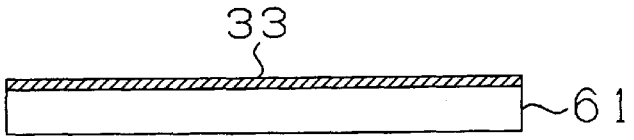
Figure 8:
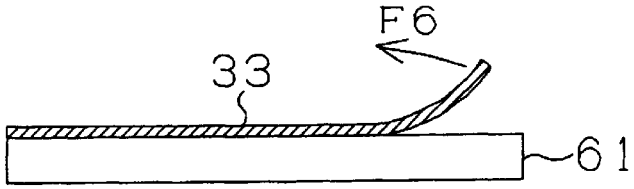
Figure 8:
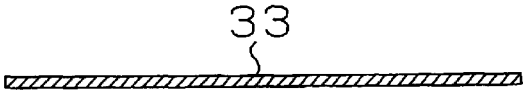
Figure 8:
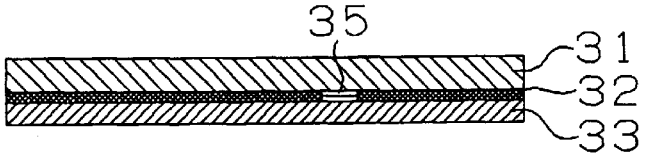
Figure 8:
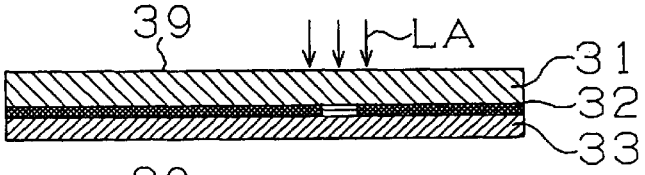
Figure 8:
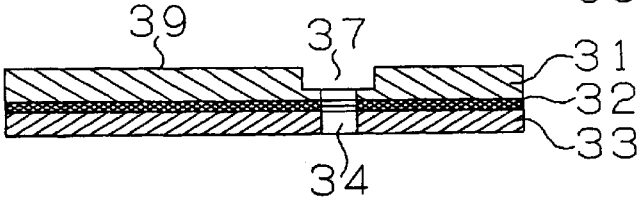

Next, a method of manufacturing the rim 33 will be described while referring FIGS. 7 to 8 (I). FIG. 7 is a schematic view representing steps for manufacturing the film 33. FIG. 8 (A) is a side view of is a beaker containing is coat liquid 60 for forming the film. FIGS. 8 (B) to 8 (I) are cross sectional views representing different phases of the aperture electrode member 30 during its manufacture.

First, in Step 2 of FIG. 7, the baking coat liquid 60 is prepared as shown in FIG. 8 (A). The baking coat liquid 60 will be used to produce the film 33. The base binder of the baking coat liquid in preferably a heat-resistant macromolecular material because of its excellent heat resistance. The heat-resistant macromolecular material is preferably a polyimide type resin material because of its ease of handling.

A lubricating additive in added to the base binder to increase smoothness at the surface of the film 33. According to the present embodiment, 1% by weight of each flourine dioxide and silicon particle are added as the lubricating additive. Alternatively, alumina can be added as the lubricating agent.

Further, an anti-static agent is added to the base binder to prevent the film 33 from charging up. According to the present embodiment, 7% by weight of carbon and 1% by weight of titanium oxide are added an the anti-static agent. Alternatively, at least one of polypyrrole, zinc oxide, polyacetylene, polythiophene can be added as the anti-static agent.

Further, a charge control agent (CCA) can be added to the base binder, such as quaternary ammonium salt or an azine compound for adjusting a positive charge, or azo dye for adjusting a negative charge.

Next, in Step 4, the baking coat liquid 60 prepared in Step 2 is coated on the surface of a plate 61. As shown in FIG. 8 (B), a squeegee 52 is drawn across the surface of the plate 61 in a direction indicated by an arrow F5 in FIG. 8 (B), in order to reduce the amount of the baking coat liquid 60 to a thin film, thereby forming the baking coat layer 63 shown in FIG. 8 (C). Instead of using the squeegee 62 to form the baking coat layer 66, the coat layer 66 could be formed using bar coat or dipping processes.

Bar coating is performed using a metal bar wrapped in a coil of thin metal wire. The liquid to be coated is supported in the gaps between the wires. When the bar is pulled across the surface of the plate 61, the liquid is coated on the surface. The liquid forms spreads out by its self weight to form a smooth even surface. Alternatively, spacers can be provided at opposite edges of the plate 61. The liquid to be coated is applied to the plate 61, between the spacers. The bar coating bar, or merely a rod, is placed on the spacers, so as to straddle the spacers, and then pulled across the top of the spacers, so that the liquid to spread across the surface of the plate 61 in a layer equal to the thickness of the spacers.

Next in S6, the plate 61 formed with the baking coat layer 63 on its surface is placed in a baking oven (not shown) and baked to produce the plate 61 with the film 33 on its surface as shown in FIG. 8 (D). The baking oven is set to a baking temperature required to harden the base binder. For example, when the base binder is polyimide, the temperature of the baking oven is set to 450° C. In this case, the baking coat layer 63 is baked for an hour. It should be noted that the insulation sheet 31 is formed to a thickness of 25 μm and the film 33 is formed to a thickness of 10 μm or greater.

Next in Step 8, the film 33 formed on the surface of the plate 61 is peeled off the plate 61 in a direction indicated by an arrow F6 in FIG. 8 (E) to prepare the separate film 33 shown in FIG. (F). The plate 61 is a glass plate with a smooth surface and that does not react at high temperatures. Because the surface is smooth, the film 33 does not physically stick to the surface of the plate, 61. Also, because the surface is does is non-reactive, the film 33 does not chemically fuse to the surface of the plate 61. Therefore, the film 33 can be easily peeled off the surface of the plate 61. Alternatively, the plate 61 could be formed from a non-oxidizing metal polished to a mirror surface.

Next, in Step 10, the film 33 is adhered to the insulation sheet 31. As shown in FIG. 8 (G), the insulation sheet 31 formed with the control electrodes 35 on its rear surface is coated with an adhesive on its rear surface to form the adhesive layer 32. In the present embodiment, the adhesive layer 32 is formed from an epoxy resin to a thickness of between 5 μm and 10 μm. It should be noted that polyimide type adhesive could be used as the adhesive instead. Then, the film 33 produced in Steps 2 to 8 is adhered to the adhesive layer 33.

Next, in Step 12, the adhesive layer 32 is hardened by heating in the baking oven to integrate the film 33 and the insulation sheet 31. The epoxy resin of the present embodiment is heated to a temperature of around 120° C. for one to two hours to harden the adhesive layer. The film 33 has a surface roughness of Rz of 1 μm or less, and so is extremely smooth.

Next, in Step 14, the upper surface 39 of the insulation sheet 31 is irradiated by laser light LA as shown in FIG. 8 (H), to open apertures 34 through the film 33, the adhesive layer 32 and the insulation shoat 31 as shown in FIG. 8 (I). Further, the indentation portions 37 an formed around the apertures 34 in the insulation sheet 31. According to the present embodiment, the laser light LA is produced using an excimer laser.

The apertures 34 are formed with a width L1 shown in FIG. 6 (C) of about 100 μm. The indentation portions 37 are formed with a width L2 shown in FIG. 6 (B) of between 200 and 300 μm. Also, the lengthwise length L3 of the apertures 34 is formed to 60 μm when the recording density is 320 dpi. In this case, 2,400 apertures 34 are formed.

The aperture electrode member 30 is completed after following Steps 2 to 14 as described above. It should be noted that the resultant electrode member 30 is provided with configuration, such as pins, slots, or grooves, for insuring that it is oriented with the film 33 facing the toner bearing roller 14 and with the indentation portions 37 facing the back electrode roller 19.

In this way, the film 33 of the aperture electrode member 30 according to the present embodiment is adhered to the insulation sheet 31 using the adhesive 32. Because the film 33 and the insulation sheet 31 are formed into an integral member using adhesive, which can be hardened by heating to a relatively low temperature, the aperture electrode member 30 will not warp by differences in thermal expansion of the insulation sheet and the coat layer as in the conventional method, wherein the insulation sheet and the coat layer are baked using high temperatures into an integral member.

Furthermore, because the polyimide can be baked at high temperatures of around 400° C., polymerization is complete, so that the resultant coat layer 63 is extremely hard, having a Young's modulus of 200 or greater, and also has a smooth surface. This is true of all materials that polymerize when heated. Because such a film 33 is adhered to the insulation sheet 31, sharp-surfaced toner particles can be prevented from piercing into the lower surface 38 of the aperture electrode member 30. Therefore, toner particles do not easily cling to the lower surface 38 of the aperture electrode member 30.

Also, because anti-static agents are incorporated in the adhesive layer 32, the film 33 can be prevented from charging so that the toner can be further prevented from clinging to the lower surface of the aperture electrode member 30.

When the aperture electrode member 30 according to the present embodiment is used in the Image forming device, conventional problems described previously can be avoided, That is to say, because toner particles do not cling to the lower surface 38 of the aperture electrode member 30, toner will not accumulate between the lower surface of the aperture electrode member 30 and the outer peripheral surface of the toner bearing roller. As a result, the space between the lower surface of the aperture electrode member 30 and the peripheral surface of the toner bearing roller will remain the same and toner particles will not clog the apertures so that the image forming device using the aperture electrode member 30 can from high quality images.

Furthermore, because any toner that does cling to the lower surface 38 of the aperture electrode member 30 will not pierce into the lower surface 38 of the aperture electrode member 30, the lower surface 38 of the aperture electrode member 30 can be easily cleaned.

Also, the indentation portions 37 reduce resistance against toner particles passing through the apertures.

The effects of the present invention are particularly striking be cause the control electrodes 35 are formed to the lower surface of the insulation sheet 31. This is because the smaller the distance separating the control electrodes 35 from the peripheral surface of the toner bearing roller 14, the stronger electric field that influences the toner particles. Therefore, movement of the toner particles can be more reliably controlled when only a small distance separates the control electrodes 35 from the toner bearing roller 14. Because the film 33 is formed extremely thin, the distance between the control electrodes 35 and the peripheral surface of the toner bearing roller 14 can be easily reduced. Therefore, the aperture electrode member 30 according to the present embodiment can control movement of toner particles with enhanced reliability.

Figure 9:
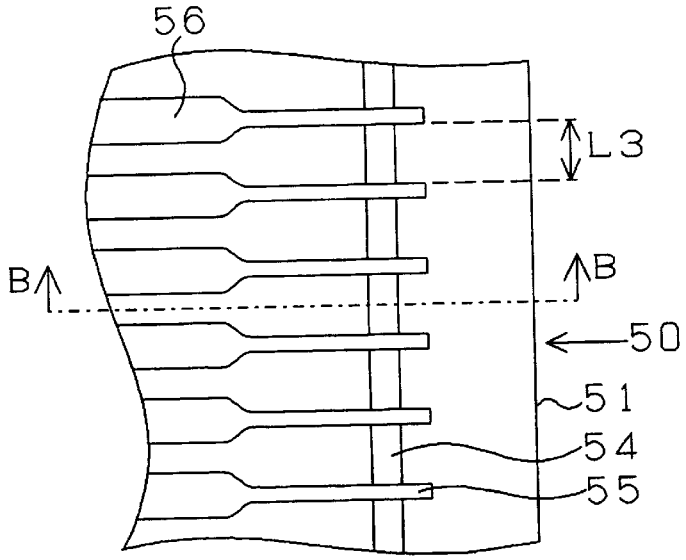
FIG. 9 (A) is a partial magnified view showing an aperture electrode member according to a second embodiment of the present invention.
Figure 9:
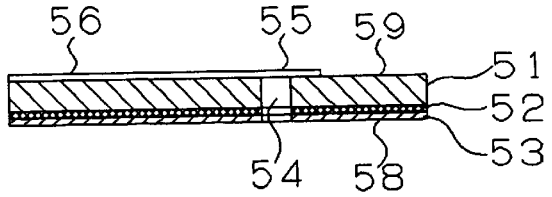
Figure 9:
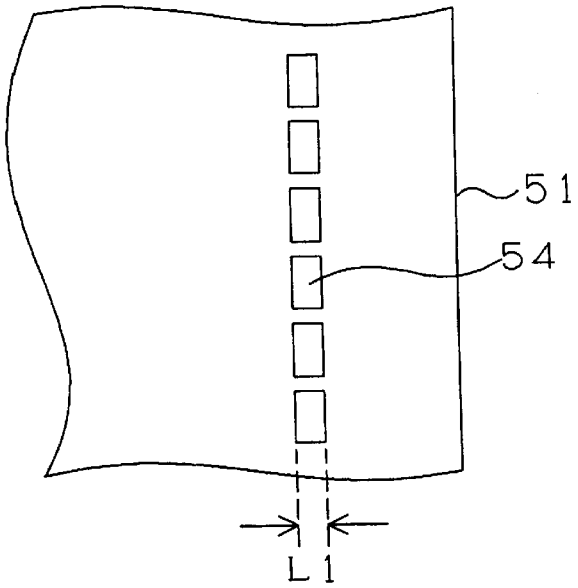

Next, an aperture electrode member according to a second embodiment of the present invention will be described while referring to FIGS. 9 (A) to 9 (C). According to the second embodiment, the aperture electrode member is formed with control electrodes on the upper surface of an insulation sheet, rather than on the lower surface as in the case of the first embodiment. FIG. 9 (A) is a partial magnified view of the aperture electrode member accordance to the second embodiment. FIG. 9 (B) is a cross-sectional view taking along a line B—B of FIG. 9 (A). FIG. 9 (C) is a partial magnified view showing a film layer according to the second embodiment.

As shown in FIG. 9 (B), the control electrodes 55 are formed on an upper surface 59 of an insulation sheet 51. The insulation sheet 51 is also formed from polyimide, and also has a resistance of greater than $10^{16}$ ohms. Connecting lines 56 are connected to the control electrodes 55. Further, a film 53 is adhered to the lower surface of the insulation sheet 51 using an adhesive layer 52. Apertures 54 art opened from the upper surface of the insulation sheet 51 through to the lower surface of the film 53. Steps for preparing the film 53, adhering the film 53, and forming the aperture 54 are the same as described in the first embodiment. According to the second embodiment, the insulation sheet 51 is formed to a thickness of 25 $\mu$m and the film 53 is formed to a thickness of a few microns.

The adhesive layer 52 according to the present embodiment has the same properties as the adhesive layer 52 of the first embodiment, that is, a modulus of elasticity of 10 to 100 kg/mm$^2$; thermal expansion coefficient of 10 to 100 ppm/° C.; a curing temperature of 200° C. or less; and a thickness of 2 microns to 20 microns or greater.

The film 53 according to the present embodiment has the same properties as the film 33 of the first embodiment, that is, has a resistance of about $10^7$ to $10^{16}$ ohms; a modulus of elasticity (Young's Modulus) of 200 kg/mm$^2$ or greater, desirably 300 kg/mm$^2$ or greater, and more desirably 900 kg/mm$^2$ or greater; a pencil hardness of H or greater, and desirably 3H or greater; a thickness of from 3 microns to 50 microns, desirably about 10 microns; and a surface roughness equivalent to a polished mirror surface, that is, Ra 0.1 micron or less.

In this way, the aperture electrode member 55 according to the second embodiment is of the type wherein the control electrodes 55 are formed to the upper surface of the insulation sheet 51, rather than on the lower surface as in the case of the first embodiment. However, in the same manner as the aperture electrode member 30 according to the first embodiment, the film 53 is adhered to, and made integral with, the insulation sheet 51 using the adhesive 52. As a result, the aperture electrode member 50 will not warp by differences in thermal expansion of the insulation sheet and the coat layer as in the conventional method, wherein the insulation sheet and the coat layer are baked using high temperatures into an integral member.

Furthermore, because the extremely hard and smooth film 53 is adhered to the insulation, sheet 51, sharp-surfaced toner particles can be prevented from piercing into the lower surface 58 of the aperture electrode member 50. Therefore, toner particles do not easily cling to the lower surface 58 of the aperture electrode member 50.

Also, because anti-static agents are incorporated in the adhesive layer 52, the film 53 can be prevented from charging so that the toner can be further prevented from clinging to the lower surface of the aperture electrode member 50.

When the aperture electrode member 50 according to the present embodiment is used in the image forming device, conventional problems described previously ran be avoided. That is to say, because toner particles do not cling to the lower surface 50 of the aperture electrode member 50, toner will not accumulate between the lower surface of the aperture electrode member 50 and the outer peripheral surface of the toner bearing roller. As a result, the space between the lower surface of the aperture electrode member 50 and the peripheral surface of the toner bearing roller will remain the same and toner particles will not clog the apertures so that the image forming device using the aperture electrode member 50 can form high quality images.

Furthermore, even if toner does cling to the lower surface 58 of the aperture electrode member 50, it will not pierce into the lower surface 58 of the aperture electrode member 50, the lower surface 53 of the aperture electrode member 50 can be easily cleaned.

While the invention has been described in detail with reference to specific embodiments thereof, it would be apparent to those skilled in the art that various changes and modifications may be made therein without departing from the spirit of the invention, the scope of which is defined by the attached claims.

For example, the base binder, the lubricating agent, the anti-static agent, the charge adjusting agent, and the adhesive material are not limited to the materials described in the embodiments. Any similar materials can be used. Also, although the adhesive layer was coated on the insulation sheet in the embodiments, the adhesive layer could be coated on the film instead.

In the embodiment, charged particles are supplied to the apertures of the aperture electrode member using a toner bearing roller 14. However, charged particles, such as toner 12, can be supplied to apertures 17*b* using flow of gas, such as air, instead. In this case also, the toner 12 conveyed or blown to the lower surface of the aperture electrode member by flow of gas, such as air, is prevented from sticking into the lower surface of the aperture electrode member.

What is claimed is:

1. A recording head for forming images with charged particles, comprising:

an insulation member having a first surface and a second surface on opposite sides thereof, and formed with through holes penetrating from the first surface to the second surface, the insulation m member being adapted to receive supply of charged particles from the first surface;

electrodes disposed one near each through hole, on one of the first surface and the second surface of the insulation member;

a film being adhered to the first surface of the insulation member at least around each through hole; and an adhesive layer interposed between the insulation member and the film, and adhering the film and the insulation member together.

2. A recording head as claimed in claim 1, wherein the film includes a main component of a heat-resistant macromolecular material.

3. A recording head as claimed in claim 2, wherein the heat-resistant macromolecular material is a polyimide resin.

4. A recording head as claimed in claim 3, wherein the film has a resistance of $10^{16}$ ohm or less and the insulation member has a resistance of greater than $10^{16}$ ohms.

5. A recording head as claimed in claim 4, wherein the film has a thickness of 3 to 50 microns.

6. A recording head as claimed in claim 1, wherein the film includes at least a lubricant and an anti-static agent.

7. A recording head as claimed in claim 1, wherein the adhesive layer has anti-static properties.

8. A recording head as claimed in claim 1, wherein the insulation member is adapted to, receive supply of charged particles from the first surface.

9. A recording head as claimed in claim 8, wherein the electrodes are disposed on the first surface and the film covers the electrodes.

10. A recording head as claimed in claim 1, wherein the insulation member is further formed with indentation portions on the second surface, for increasing diameter of the through holes.

11. An image forming device for forming images with charged particles, comprising:

a charged particle supply unit that supplies the charged particles;

a medium support that supports a medium for receiving the charged particles; and a recording head interposed between the charged particle supply unit and the medium support, and including:

an insulation member having a first surface and a second surface on opposite sides thereof, the first surface confronting the charged particle supply unit, the second surface confronting the medium support, the insulation member being formed with through holes penetrating from the first surface to the second surface;

electrodes disposed one near each through hole, on one of the first surface and the second surface of the insulation member; and film having properties that prevent clinging of charged particles thereto, the film being adhered to the first surface of the insulation member at least around each through hole; and an adhesive layer interposed between the insulation member and the film, and adhering the film and the insulation member together.

12. An image forming device as claimed in claim 11, wherein the charged particle supply unit includes a moving member with a moving surface that supports the charged particles to be supplied, the moving surface supplying the charged particles to the recording head by contact.

13. A recording head an claimed in claim 11, wherein the film includes a main component of a heat-resistant macromolecular material.

14. A recording head as claimed in claim 13, wherein the heat-resistant macromolecular material is a polyimide resin.

15. A recording head as claimed in 14, wherein the film has it resistance of $10^{16}$ ohms or less and the insulation member has a resistance of greater than $10^{15}$ ohms.

16. An image forming device as claimed in claim 15, wherein the film has a thickness of 3 to 50 microns.

17. A recording head as claimed in claim 11, wherein the film includes at least a lubricant and an anti-static agent.

18. A recording head as claimed in claim 11, wherein the adhesive layer has anti-static properties.

19. A method of producing a recording head, including the steps of:

preparing a film having properties that prevent clinging of charged particles thereto; and adhering the film, using an adhesive, to at least certain portions on one surface of an insulation member, the insulation member being adapted to receive supply of charged particles from the one surface.

20. A method as claimed in claim 17, further including the step of forming apertures through the insulation member at the certain portions so that openings of the apertures are surrounded by the film.

21. A method as claimed in claim 19, wherein the step of adhering is performed by coating the at least certain portions on the one surface of the insulation member with the adhesive, and attaching the film to the adhesive.

22. A method as claimed in claim 19, wherein the step of adhering is performed by coating the adhesive on the film, and attaching the film, using the adhesive, to the at least certain portions on the one surface of the insulation member.

23. A method as claimed in claim 19, wherein the step of preparing the film includes forming the film to a thickness of 3 to 50 microns.

* * * * *